US009318282B2

(12) United States Patent
Nakajima et al.

(10) Patent No.: US 9,318,282 B2
(45) Date of Patent: Apr. 19, 2016

(54) KEYBOARD

(71) Applicant: FUJITSU COMPONENT LIMITED, Tokyo (JP)

(72) Inventors: Takashi Nakajima, Tokyo (JP); Hiromi Ohtsuka, Tokyo (JP); Daisuke Taga, Tokyo (JP); Fujio Seki, Tokyo (JP)

(73) Assignee: FUJITSU COMPONENT LIMITED, Toyko (JP)

( * ) Notice: Subject to any disclaimer, the term of this patent is extended or adjusted under 35 U.S.C. 154(b) by 88 days.

(21) Appl. No.: 14/047,493

(22) Filed: Oct. 7, 2013

(65) Prior Publication Data

US 2014/0102868 A1 Apr. 17, 2014

(30) Foreign Application Priority Data

Oct. 16, 2012 (JP) ..... 2012-229131

(51) Int. Cl.
*H01H 13/76* (2006.01)
*H01H 13/85* (2006.01)

(52) U.S. Cl.
CPC ..... *H01H 13/76* (2013.01); *H01H 13/85* (2013.01); *H01H 2215/028* (2013.01); *H01H 2221/066* (2013.01)

(58) Field of Classification Search
CPC ..... H01H 13/70; H01H 13/76
USPC ..... 200/5 A, 5 E, 16 R, 16 A, 16 C, 18, 200/510–517, 341, 344, 345
See application file for complete search history.

(56) References Cited

U.S. PATENT DOCUMENTS 4,830,526 A * 5/1989 Hosono ..... 400/490
5,565,865 A * 10/1996 So ..... 341/20
5,668,358 A * 9/1997 Wolf et al. ..... 200/5 A
7,462,796 B1 * 12/2008 Chai ..... 200/341

FOREIGN PATENT DOCUMENTS

JP 3023495 1/1996
JP 2006-179361 7/2006

* cited by examiner

*Primary Examiner* — Edwin A. Leon
*Assistant Examiner* — Iman Malakooti
(74) *Attorney, Agent, or Firm* — Staas & Halsey LLP

(57) ABSTRACT

A keyboard is provided with a base member, moving members provided on the base member and unit parts. Each of the unit parts includes a contact which is electrically connected when depressed and an elastic member. The moving members include a first moving member which engages with one unit part, and a second moving member which engages with plural unit parts. The second moving member has a structure where the second moving member pushes the elastic member of one unit part and avoids pushing the elastic member of the other unit part.

7 Claims, 12 Drawing Sheets

KEYBOARD

CROSS-REFERENCE TO RELATED APPLICATIONS

This application is based upon and claims the benefit of priority of the prior Japanese Patent Application No. 2012-229131, filed Oct. 16, 2012, the entire contents of which are incorporated herein by reference.

BACKGROUND OF THE INVENTION

1. Field of the Invention

The present invention relates to a keyboard.

2. Description of the Related Art

A keyboard is used to enter information into a POS (Point of Sales) system of a store etc. The keyboard is provided with a plurality of keyswitch devices which are formed for predetermined information. By pushing a keyswitch device, predetermined information is input. For example, at the surfaces of the keytops, letters, symbols, and other information to be input are engraved. By pushing a keytop, a key input signal corresponding to the input information which is engraved on the keytop can be sent to the system.

In this regard, in recent years, there has been known a keyboard which enables layout of the keytops (key array) to be changed. Further, there has been known a keyboard which enables the sizes of the keytops to be changed. Such keyboards enable the arrangement of the keyboard and size of the keytops to be changed in accordance with the desire of the user, so the convenience of operation is improved.

Japanese Registered Utility Model No. 3023495 discloses a keyboard which enables the keycaps which are used for cash registers to be freely changed. In this keyboard, keybases to which keycaps are to be attached are arranged on a panel at equal intervals. It discloses that by providing connecting columns at predetermined intervals at the back surfaces of the keycaps, replacement is possible without being limited to single dimension keys, double dimension keys, quadruple dimension keys, and other specifications.

Japanese Patent Publication No. 2006-179361A discloses a keyboard which has keytop bases to which keytops which operate contacts of a circuit board by a pushing operation are attached to be able to move in the vertical direction inside a top case and which has keycaps which are attached detachably at the top parts of the keytop bases and stick out upward from the key openings of the top case. In this keyboard, a decorative panel which is attached detachably to the top surface of the top case is provided with keycap insertion holes into which the keycaps are inserted. This discloses that it is possible to replace the keycaps of the keytops simply without disassembling the device case.

As disclosed in Japanese Registered Utility Model No. 3023495, in a keyboard where the size of a keytop which the user pushes can be changed, for example, single dimension keytops can be changed to double dimension keytop etc. In this regard, when changing only a keytop, that is, when changing only the parts which the user pushes, sometimes the operating load when pushing the keytop changes. For example, when single dimension keytops are biased by single coil springs to stick out upward, if attaching a double dimension keytop, it will be biased by two coil springs. For this reason, the operating load of a double dimension keytop becomes larger than the operating load of a single dimension keytop. For example, a double dimension keytop would have to be pushed by about double the force. For this reason, when replacing a keytop, the feeling of operation by the user would deteriorate or the keytop would not be sufficiently pushed and the contact would not be connected.

Furthermore, a keyboard is formed with single contacts able to be operated by single dimension keytops, so if changing single dimension keytops to a double dimension keytop, a plurality of contacts would be connected and mistaken operation would be liable to occur.

For this reason, if changing the size of a keytop, for example, it is possible to detach a member pushing against the membrane sheet. After that, a different sized keytop may be attached. In this regard, a coil spring which pushes against the membrane sheet etc. is arranged inside of a slider which supports the keytop. When changing the size of a keytop, the keytop and slider have to be pulled out, then part of the coil springs etc. has to be detached. There is the problem that a long time is taken for assembling the keyboard or changing the layout of the keytops.

SUMMARY OF THE INVENTION

The keyboard of the present invention is provided with a base member, moving members provided on the base member, each of which moves when being pushed and unit parts. Each of the unit parts includes a contact which is formed in an electrical connecting member and electrically connected when depressed, an elastic member which is arranged between the moving member and the electrical connecting member, which deforms upon being pushed by the moving member and which pushes the electrical connecting member and a support part provided on the base member that supports the moving member. The moving members include a first moving member which engages with one unit part, and a second moving member which engages with plural unit parts. The first moving member and the second moving member are exchangeably attached to and detached from the base member The second moving member has a structure where the second moving member pushes the elastic member of one unit part among the unit parts which are engaged with and avoids pushing the elastic member of the other unit part.

DESCRIPTION OF EMBODIMENTS

Referring to FIG. 1 to FIG. 14B, a keyboard of an embodiment will be explained. In the present embodiment, the explanation will be given illustrating a keyboard which is employed in a POS (Point of Sales) system.

Figure 1:
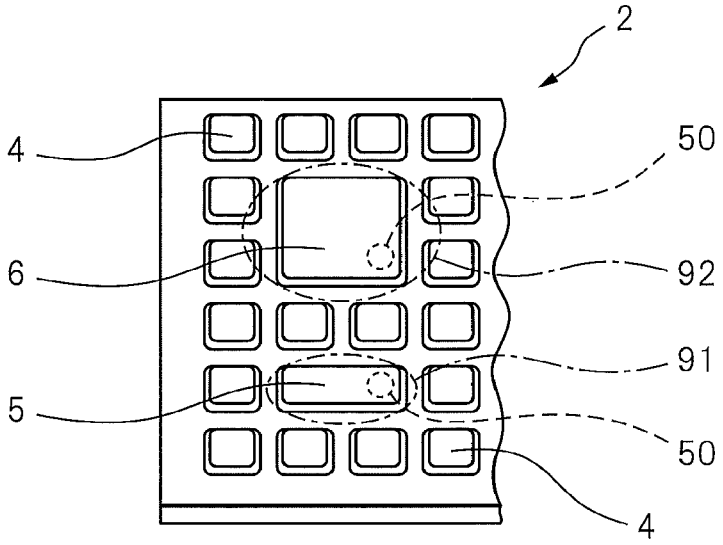
FIG. 1 is a schematic perspective view which explains a first state of a keyboard of an embodiment.

FIG. 1 is a schematic perspective view which explains a first state of the keyboard of the present embodiment. The keyboard 2 of the present embodiment has a plurality of keyswitch devices. Each keyswitch device includes a slider that moves when the keytop is pressed, and a unit part which supports the slider and has a contact which is connected by movement of the moving member.

In the first state, keytops 4, 5, and 6 of different shapes are arranged. The keytop 4 is a single dimension keytop which corresponds to one unit part. The keytops 5 and 6 correspond to the plurality of unit parts. The keytop 5 is a double dimension keytop which corresponds to two unit parts and has a pushing surface of an area about two times that of the keytop 4. The keytop 6 is a quadruple dimension keytop which corresponds to four unit parts and has a pushing surface of an area about four times that of the keytop 4. A region 91 is a region at which the double dimension keytop 5 is arranged, while a region 92 is a region at which the quadruple dimension keytop 6 is arranged. Further, a connected unit part 50, as explained later, which is a unit part among unit parts which corresponds to one keytop at which a contact is connected when the keytop is pushed, is provided.

Figure 2:
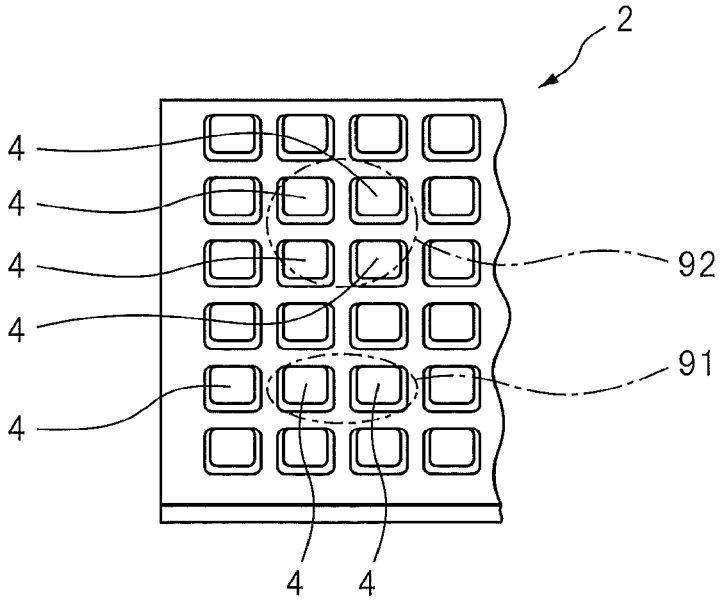
FIG. 2 is a schematic perspective view which explains a second state of a keyboard of an embodiment.

FIG. 2 is a schematic perspective view which explains a second state of the keyboard of the present embodiment. In the second state, single dimension keytops 4 are arranged for all of the unit parts. The keyboard of the present embodiment as shown in FIG. 1 and FIG. 2 is formed to enable change of the size of a keytop. For example, it is possible to detach the two keytops 4 as shown in FIG. 2 from the region 91 and attach a single keytop 5 to the region 91 as shown in FIG. 1. Further, it is possible to detach the four keytops 4 from the region 92 as shown in FIG. 2 and attach a single keytop 6 to the region 92 as shown in FIG. 1.

The moving members include a first moving member and a second moving member. The keyboard of the present embodiment is formed to enable attachment of the first moving members and the second moving members. A first moving member is a moving member which is provided for one unit part, while second moving member is a moving member which is provided for plural unit parts.

Figure 3:
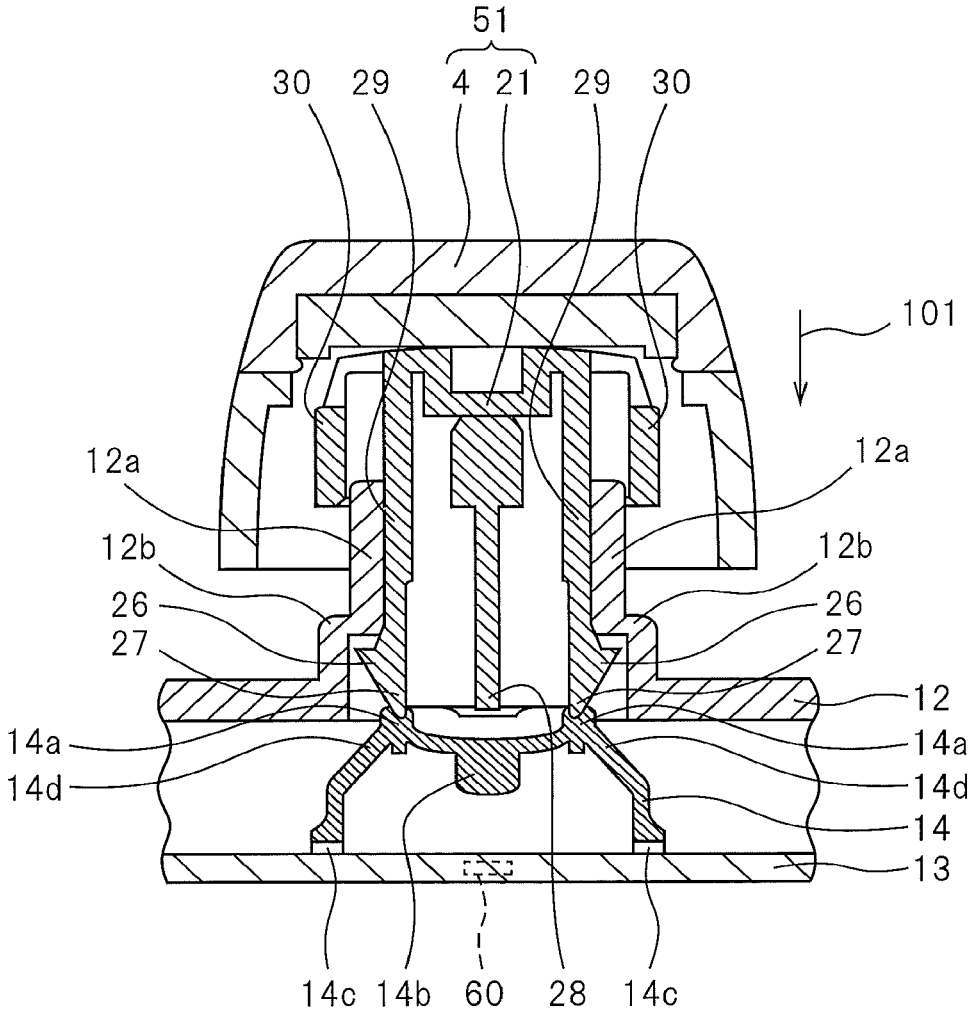
FIG. 3 is a schematic cross-sectional view of a keyswitch device at which a single dimension keytop is arranged in a first keyboard of an embodiment.

FIG. 3 is a schematic cross-sectional view of a keyswitch device at which a first moving member is arranged. At the keyswitch device of FIG. 3, a single dimension keytop is arranged. The keyboard 2 is provided with a first moving member 51 and a base member which includes a support part 12*a* that supports the first moving member 51. The support part 12*a* is formed into a tubular shape.

In the present embodiment, a part which includes a contact 60 which is included in a membrane sheet 13, a rubber cup 14 and a support part 12*a* is called a "unit part". For example, one unit part supports one slider and includes one contact 60. The keyboard 2 has a plurality of unit parts. In the keyswitch device which is shown in FIG. 3, a first moving member 51 is arranged for one unit part.

The first moving member 51 includes a slider 21 onto which a keytop 4 is provided. The keytop 4 is formed into a box shape with one open side. The keytop 4 is supported by one slider 21. The slider 21 engages with one unit part and functions as a first engagement part which pushes the rubber cup 14. In the present embodiment, the keytop 4 is fastened to the slider 21. The keytop 4 and the slider 21 can be detached from and attached to the base member 12 together.

The slider 21 has a sliding part which slides against the support part 12*a*. The sliding part includes an inside sliding part 29 which slides against the inside surface of the support part 12*a* and an outside sliding part 30 which slides against the outside surface of the support part 12*a*. The inside sliding part 29 is inserted in the inside of the support part 12*a*. In the present embodiment, the inside sliding part 29 and the outside sliding part 30 are engaged with the support part 12*a*.

The inside sliding part 29 of the slider 21 has stopping tabs 26 which engage the slider 21 with the base member 12. The stopping tabs 26 are engaged with stopping parts 12*b* which are formed at the base member 12. The stopping tabs 26 catch on the stopping parts 12*b* and the slider 21 can be prevented from jumping out from the base member 12. Further, at the front end of the inside sliding part 29, a pushing part 27 for pushing the rubber cup 14 is formed.

At the bottom side of the base member 12, a membrane sheet 13 is arranged as an electrical connecting member. The membrane sheet 13 has contacts 60 inside it. Each contact 60 contains a pair of electrodes facing each other. The electrodes contact each other when the contact 60 is pushed and the electrical circuit in which these electrodes are arranged is electrically connected. The membrane sheet 13 is formed so that a contact 60 is electrically connected when a certain location is pushed. The contact 60 is formed so that one electrode and another electrode contact each other, but the invention is not limited to this type of contact. Contact may also be formed to have a plurality pairs of electrodes which contact each other. Further, the membrane sheet 13 may include spacers which form a clearance between an upper layer and a lower layer of the membrane sheet 13. The membrane sheet may also be formed so that each contact includes a plurality of upper electrodes arranged at an upper layer and a plurality of lower electrodes arranged at a lower layer, and the plurality of upper electrodes and the plurality of lower electrodes contact each other. Further, an electrical connecting member is not limited to a membrane sheet. Any member which enables electrical connection by being pushed may be employed.

Between the membrane sheet 13 and a slider 21, an elastic member, which is a rubber cup 14 in this embodiment, is arranged. The rubber cup 14 has elasticity and biases the slider 21 in a direction away from the membrane sheet 13.

The rubber cup 14 has an abutting part 14*a* which abuts against the pushing part 27 of the slider 21. The abutting part 14*a* is formed in a tubular shape. The abutting part 14*a* of the rubber cup 14 is pushed by the pushing part 27 of the slider 21. The rubber cup 14 has a deformation part 14*d* that deforms when the abutting part 14*a* is pushed and provides a reaction force to the slider 21. The deformation part 14*d* causes buckling deformation when the abutting part 14*a* is pushed. Further, the deformation part 14*d* returns to its original shape when the pushing force is released. The rubber cup 14 includes a recess 14*c* through which air circulates when the rubber cup 14 is deformed. The recess 14*c* is formed at the rubber cup 14 to be recessed from the contact surface with the membrane sheet 13.

The rubber cup 14 has a pushing part 14*b* which pushes a region where a contact 30 of the membrane sheet 13 is arranged. The pushing part 14*b* is arranged at inside surface of the rubber cup 14 so as to face the membrane sheet 13. Further, the slider 21 is formed with a rod-shaped part 28 which pushes the pushing part 14*b*.

In the keyswitch device of the present embodiment, when the user pushes a keytop 4 to a direction as shown by the arrow 101, the keytop 4 and the slider 21 move toward the base member 12. When the moving member 51 moves, the inside sliding part 29 and outside sliding part 30 of the slider 21 slide with respect to the support part 12*a*, and the slider 21 moves along the support part 12*a*. The pushing part 27 of the slider 21 which moves downward as illustrated pushes the abutting part 14*a* of the rubber cup 14 and the deformation part 14*d* of the rubber cup 14 deforms. Further, along with downward movement of the slider 21, the rod-shaped part 28 of the slider 21 pushes the pushing part 14*b* of the rubber cup 14, so the pushing part 14*b* of the rubber cup 14 contacts and pushes the membrane sheet 13. Due to this, the contact 60 which is provided inside of the membrane sheet 13 is electrically connected.

When a user releases his or her finger from the keytop 4, the rubber cup 14 returns to its original shape, so the elasticity of the rubber cup 14 causes the keytop 4 and the slider 21 to return to their original positions. Due to this, the membrane sheet 13 is no longer pushed by the pushing part 14*b*, so the contact 60 is released. In this way, the keyswitch device can connect and disconnect the contact 60 which is formed in the membrane sheet 13.

Figure 4:
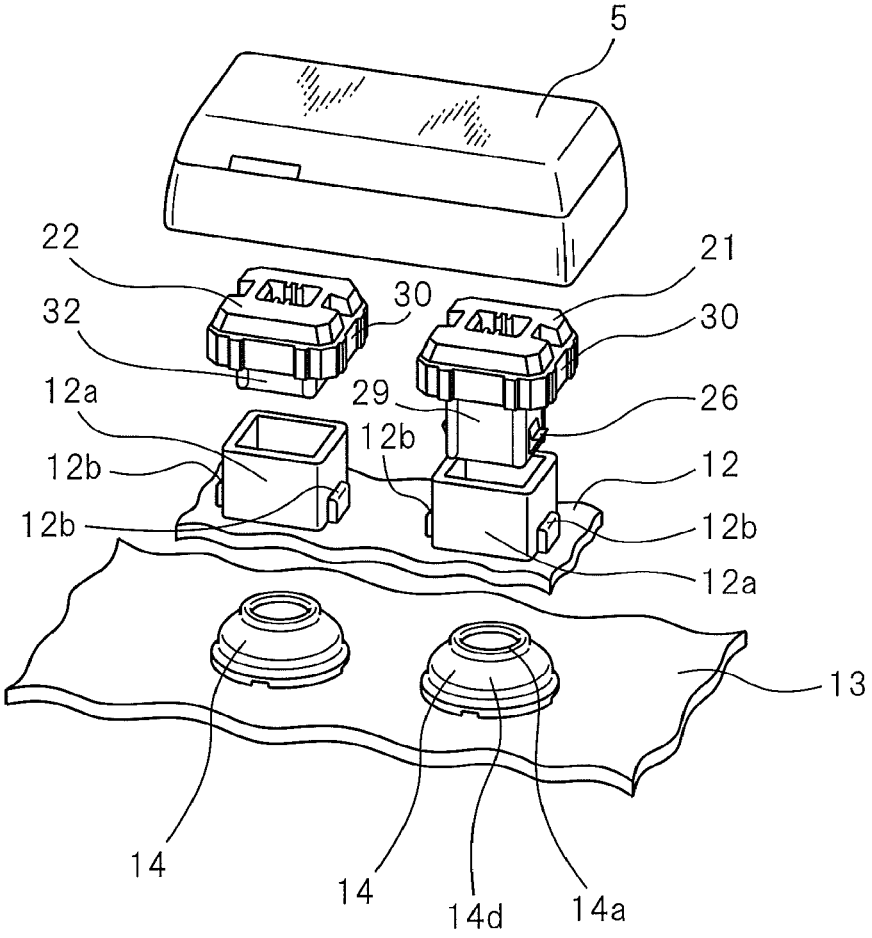
FIG. 4 is a schematic disassembled perspective view of a keyswitch device at which a double dimension keytop is arranged in a first keyboard of an embodiment.
Figure 5:
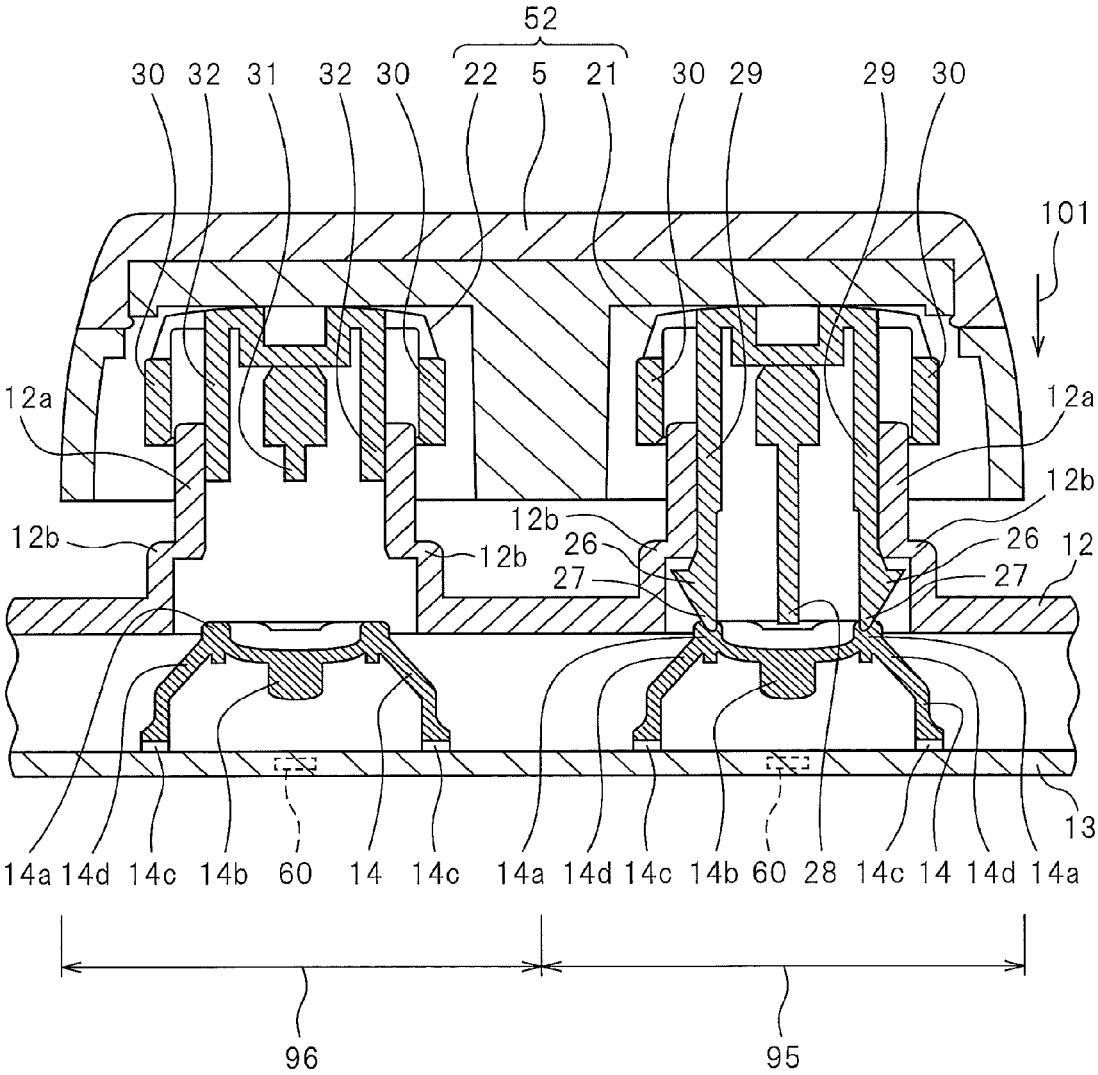
FIG. 5 is a schematic cross-sectional view of a keyswitch device at which a double dimension keytop is arranged in a first keyboard of an embodiment.

FIG. 4 is a schematic disassembled perspective view of a keyswitch device at which a second moving member is arranged in the keyboard in the present embodiment. FIG. 5 is a schematic cross-sectional view of a keyswitch device at which a second moving member is arranged. In the keyswitch device which is shown in FIG. 4 and FIG. 5, a double dimension keytop is arranged.

Referring to FIG. 4 and FIG. 5, the keyboard 2 is formed to enable attachment of a second moving member 52 which engages with a plurality of unit parts. The second moving member includes a plurality of sliders which function as engagement parts which engage with the unit parts. The second moving member includes a first engagement part which engages with one unit part and pushes the rubber cup 14 and a second engagement part engages with the other unit part but avoids pushing the rubber cup 14. In the example as shown in FIG. 4 and FIG. 5, the second moving member 52 includes sliders 21 and 22 onto which a single keytop 5 is provided. The slider 21 functions as the first engagement part, while the slider 22 functions as the second engagement part. The keytop 5 is fastened to the tops of two sliders 21 and 22. The second moving member 52 is formed so that the keytop 5 and sliders 21 and 22 can be integrally detached and attached from the keyboard.

The unit parts which engage with the sliders 21 and 22 may be classified as a unit part at which a contact 60 is connected, and a unit part at which a contact 60 is not connected and the open state is maintained when the second moving member 52 is pushed. A unit part at which a contact 60 is connected is called a "connected unit part", while a unit part at which a contact 60 is not connected and an open state is maintained is called a "non-connected unit part". A region 95 is a region of a connected unit part, while a region 96 is a region of a non-connected unit part. Further, the region 95 is a region at which the first engagement part is arranged, while the region 96 is a region where the second engagement part is arranged.

The structure of the slider 21 which is arranged at the region 95 is similar to the structure of the slider 21 of the keyswitch device which includes the single dimension keytop 4 which is shown in FIG. 3. The slider 21 engages with the connected unit part.

The second moving member 52 includes a slider 22 which engages with the non-connected unit part at the region 96. The slider 22 includes an inside sliding part 32 and an outside sliding part 30. The inside sliding part 32 of the slider 22 is formed shorter than the inside sliding part 29 of the slider 21 which engages with the connected unit part. The inside sliding part 32 of the slider 22 is formed short so that when the keytop 5 is pushed, the front end of the inside sliding part 32 will not contact the rubber cup 14. That is, the inside sliding part 32 of the slider 22 does not push the abutting part 14*a* of the rubber cup 14. Further, the rod-shaped part 31 of the slider 22 is formed shorter than the rod-shaped part 28 of the slider 21. The rod-shaped part 31 avoids pushing the pushing part 14*b* of the rubber cup 14. In this way, the slider 22 of the second moving member 52 can avoid pushing the rubber cup 14.

When the user pushes the keytop 5 in the direction which is shown by an arrow 101 at the connected unit part, the inside sliding part 29 of the slider 21 pushes the rubber cup 14 and the contact 60 at the inside of the membrane sheet 13 is connected. In this regard, at the non-connected unit part, the inside sliding part 32 and rod-shaped part 31 of the slider 22 do not reach the rubber cup 14, so the contact 60 at the inside of the membrane sheet 13 is maintained in an open state.

In this way, the second moving member 52 is supported by a plurality of support parts 12*a* and pushes the rubber cup 14 of one unit part to connect the contact 60. Furthermore, the second moving member 52 can avoid pushing the rubber cup 14 of the other unit part. By employing this configuration, the operating load when a first moving member 51 which includes a single slider is arranged at a single unit part and the operating load when a second moving member 52 which includes a plurality of sliders at a plurality of unit parts can be made substantially the same.

Referring to FIG. 1 and FIG. 2, when replacing a moving member, a certain moving member can be pulled out, then another moving member can be provided. For example, in FIG. 2, two first moving members 51, each of which includes one slider 21 arranged in the region 91, are pulled out. After that, as shown in FIG. 1, a second moving member 52 which includes a slider 21 and a slider 22 can be attached.

Figure 6:
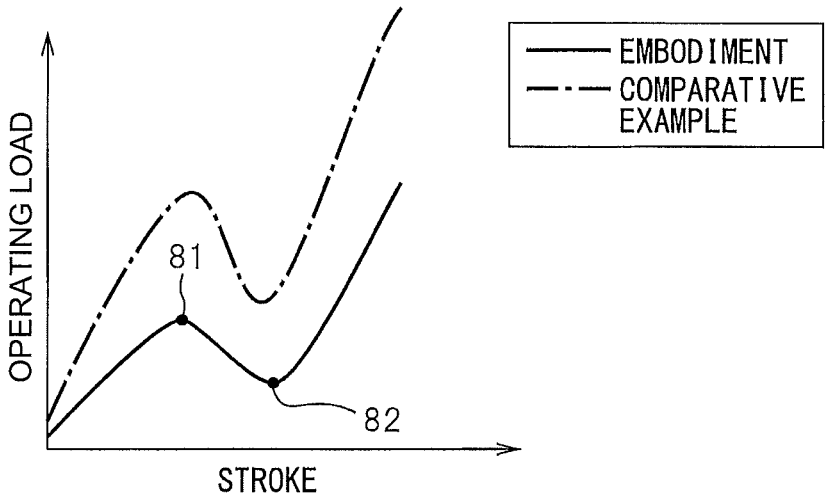
FIG. 6 is a graph which explains a pushing characteristic of a keyboard of an embodiment.

FIG. 6 is a graph which explains an operating load when pushing the second moving member of the present embodiment. The solid line shows the characteristics of the load when pushing the second moving member 52. The abscissa shows a stroke consisting of the amount of pushing of the keytop, while the ordinate shows the operating load.

When the user starts to push a keytop 5, that is, when a stroke increases from zero, the rubber cup 14 deforms and the operating load becomes larger. At a predetermined stroke, the deformation part 14*d* of the rubber cup 14 cause buckling and the local maximum point 81 appears. If the stroke becomes larger than the position of the local maximum point 81, the operating load gradually decreases. When the stroke becomes further larger, a local minimum point 82 appears. The contact 60 of the membrane sheet 13 is, for example, connected at the local minimum point 82. If the stroke becomes larger than the position of the local minimum point 82, the operating load again rises.

The second moving member of the present embodiment is formed so as to push the rubber cup of one unit part. The load when pushing the second moving member 52 with a double dimension keytop 5 becomes substantially the same as the load when pushing the first moving member 51 with a single dimension keytop 4. That is, even when pushing the first moving member 51, the load becomes substantially the same as the load of the solid line which is shown in FIG. 6. For this reason, even when replacing first moving members 51 with a second moving member 52, the user can operate the keyswitch device without a strange feeling. Further, in the same way, even which replacing a second moving member 52 with first moving members 51, the user can operate the keyswitch device without a strange feeling.

Here, a keyboard of a comparative example will be explained. A moving member of the keyboard of the comparative example pushes elastic members at a plurality of unit parts and pushes a plurality of contacts with the unit parts.

Figure 7:
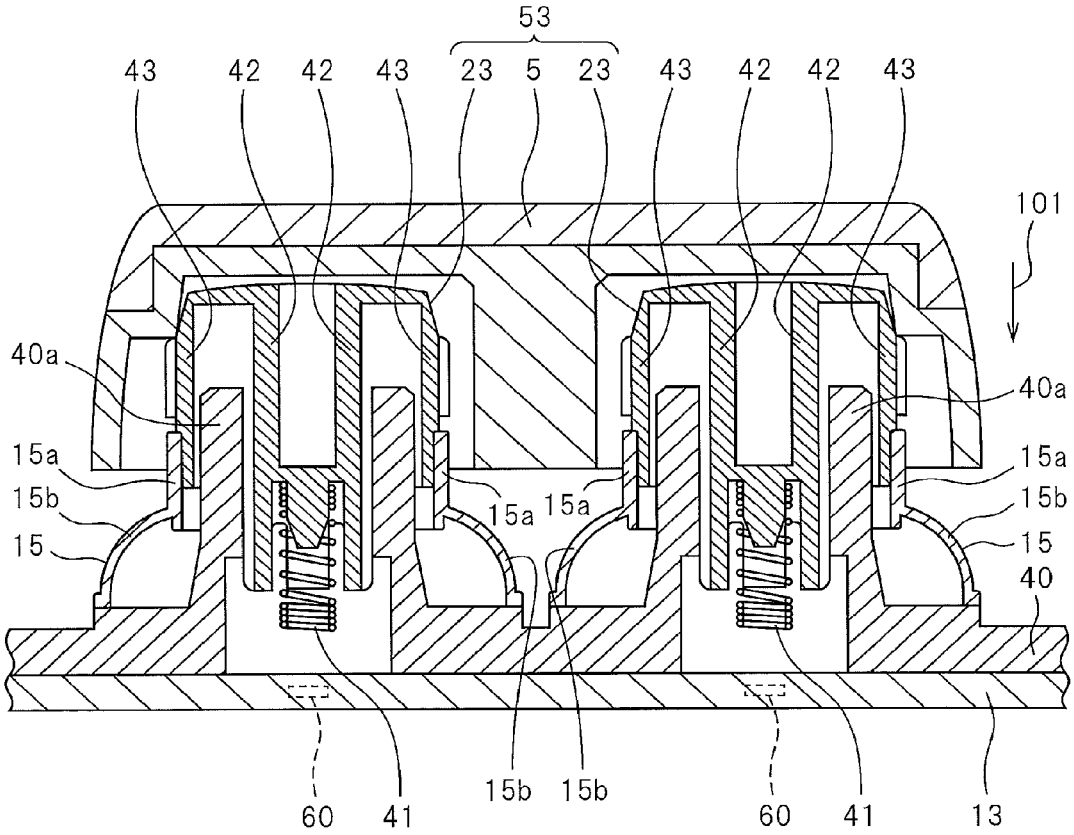
FIG. 7 is a schematic cross-sectional view of a keyswitch device at which a double dimension keytop is arranged in a keyboard of a comparative example.

FIG. 7 is a schematic cross-sectional view of a keyswitch device of the comparative example at which a double dimension keytop is arranged. The keyboard of the comparative example is provided with a base member 40 which includes a support part 40*a*. The moving member 53 of the keyboard of the comparative example includes a keytop 5 and two sliders 23. Each slider 23 has an inside sliding part 42 and an outside sliding part 43. The keyboard of the comparative example includes an elastic member 15 which provides a reaction force to the moving member 53. The elastic member 15 includes a tubular part 15*a* which has a tubular shape and a deformation part 15*b*. The tubular part 15*a* contacts the outside sliding part 43. The tubular part 15*a* pushes the deformation part 15*b* without substantially deforming when the keytop 5 is pushed.

Further, each slider 23 has a coil spring 41 attached to it. The coil spring 41 pushes the membrane sheet 13 when the keytop 5 is pushed. In the comparative example which is shown in FIG. 7, elastic members 15 are arranged at two unit parts. By pushing the keytop 5, both elastic members 15 deform.

Referring to FIG. 6, the one-dot chain line shows the load of the keyswitch device at which a double dimension keytop of the comparative example which is shown in FIG. 7 is arranged. In the keyboard of the comparative example, it is learned that in the region of the overall stroke by which the moving member 53 moves, the load becomes larger than the load of the keyboard of the present embodiment. That is, in the keyboard of the comparative example, a large force is required when pushing a moving member 53 with a double dimension keytop. The key operation feels harder. For this reason, sometimes the operation feels strange. As opposed to this, the keyboard of the present embodiment enables the load to be kept substantially the same even if replacing a first moving member 51 which engages with one unit part and a second moving member 52 which engages with a plurality of unit parts with each other, so it is possible to keep a strange feeling from being given to the operation.

Referring to FIG. 7, in a keyswitch device which has a double dimension keytop of the comparative example, to obtain an operating load similar to a keyswitch device which has a single dimension keytop, for example, it is necessary to detach one elastic member 15 and one coil spring 41 or necessary to change the two elastic materials to materials which deform by a lighter pushing force and to remove the coil springs 41, so this is troublesome. As opposed to this, in the keyboard of the present embodiment, the second moving member is formed so as to push the rubber cup of one unit part and to avoid pushing the rubber cup of the other unit part. For this reason, the work of detaching certain parts when replacing the moving member becomes unnecessary and the size of a keytop can be easily changed.

Further, referring to FIG. 7, in the keyboard of the comparative example, two coil springs 41 push the membrane sheet 13 by a single operation. That is, two contacts 60 which are formed at the membrane sheet 13 are connected. Since two contacts 60 are connected substantially simultaneously, sometimes an electrically false response occurs.

As opposed to this, in the present embodiment, referring to FIG. 5, the contact 60 of the connected unit part of the region 95 is connected, while the open state of the contact 60 is maintained at the non-connected unit part of the region 96. By a single pushing action, a single contact 60 which is formed in the membrane sheet 13 is connected. In this way, in the present embodiment, a plurality of contacts being connected simultaneously is avoided and electrically mistaken response etc. can be suppressed.

Figure 8:
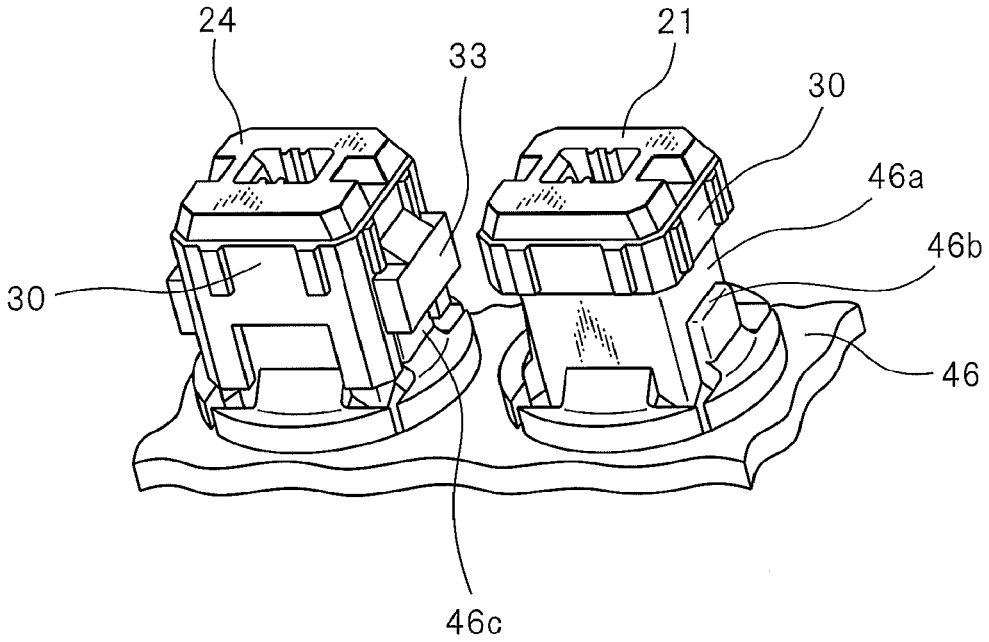
FIG. 8 is a schematic perspective view of support parts and sliders of a keyswitch device at which a double dimension keytop is arranged in a second keyboard of an embodiment.
Figure 9:
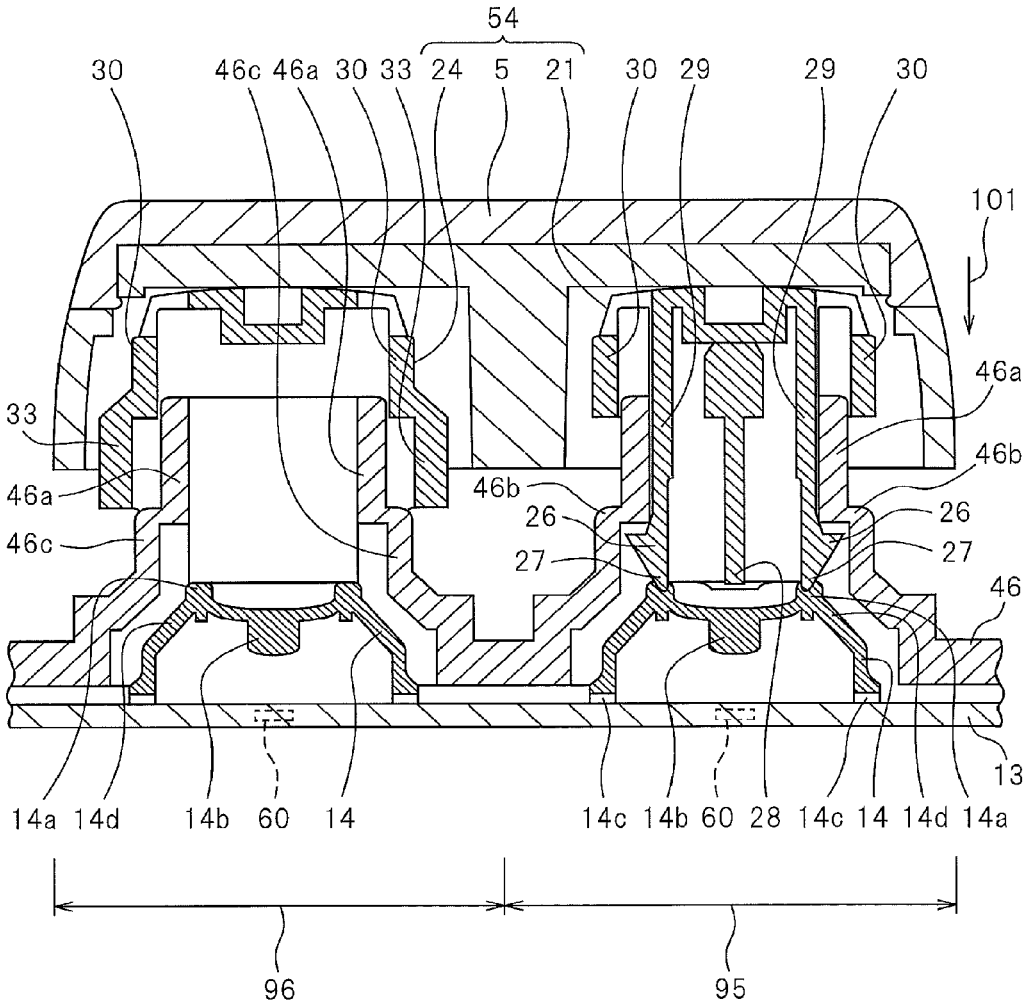
FIG. 9 is a schematic cross-sectional view of a keyswitch device at which a double dimension keytop is arranged in a second keyboard of an embodiment.

FIG. 8 is a schematic perspective view of sliders and support parts of a keyswitch device at which a double dimension keytop is arranged in a second keyboard of the present embodiment. FIG. 9 is a schematic cross-sectional view of a keyswitch device at which a second moving member is arranged in the second keyboard. Referring to FIG. 8 and FIG. 9, the second keyboard of the present embodiment is formed so as to enable attachment of a second moving member 54 which engages with a plurality of unit parts. The structure of the region 95 is similar to the structure of the first keyboard (see FIG. 5). That is, a unit part is configured by arranging a slider 21 which functions as a first engagement part which pushes the rubber cup 14. The slider 21 slides against the support part 46*a* of the base member 46. The stopping tabs 26 engage with the stopping parts 46*b*.

In the second keyboard, the second moving member 54 includes a slider 24 which engages with a non-connected unit part of the region 96. The slider 24 functions as a second engagement part. The slider 24 does not have an inside sliding part. Furthermore, the slider 24 does not have a rod-shaped part 28 which pushes the pushing part 14*b* of the rubber cup 14. On the other hand, the slider 24 includes outside sliding parts 30 and 33 which slide against the outer surfaces of the support parts 46*a* and 46*c* of the base member 46.

The base member 46 of the second keyboard has a support part 46*a* and a stopping part 46*b*. Furthermore, the base member 46 has a support part 46*c*. The support part 46*a* is formed in a tubular shape. The support part 46*c* is connected to an end of the support part 46*a*. The support part 46*c* is formed so as to bulge outward from the support part 46*a*. The outside sliding part 30 is formed so as to face the support part 46*a* and slides against the support part 46*a*. The outside sliding part 33 is formed so as to face the support part 46*c* and slides against the support part 46*c*. In this way, the inside sliding part can be eliminated from the slider 24. The insides of the support parts 46*a* and 46*c* form empty spaces.

In the second keyboard as well, when the second moving member 54 is pushed, it is possible to avoid the rubber cup 14 which is arranged at the non-connected part at the region 96 from being pushed. Further, it is possible to keep the load from changing when replacing a moving member. When pushing a keytop 5, at the connected unit part of the region 95, the contact 60 of the membrane sheet 13 is connected, while at the non-connected unit part of region 96, the contact 60 of the membrane sheet 13 can be maintained in the open state.

Further, in the second moving member 54, even if the slider 24 is not formed with an inside sliding part, the outside sliding parts 30 and 33 may slide with respect to the support parts 46*a* and 46*c* to enable the slider 24 to stably move with respect to the base member 46. That is, the second moving member 54 can be made to stably move. The slider 24 which is arranged in the region 96 is not limited to this. Any structure can be used for support by the support parts 46*a* and 46*c* of the base member 46.

Figure 10:
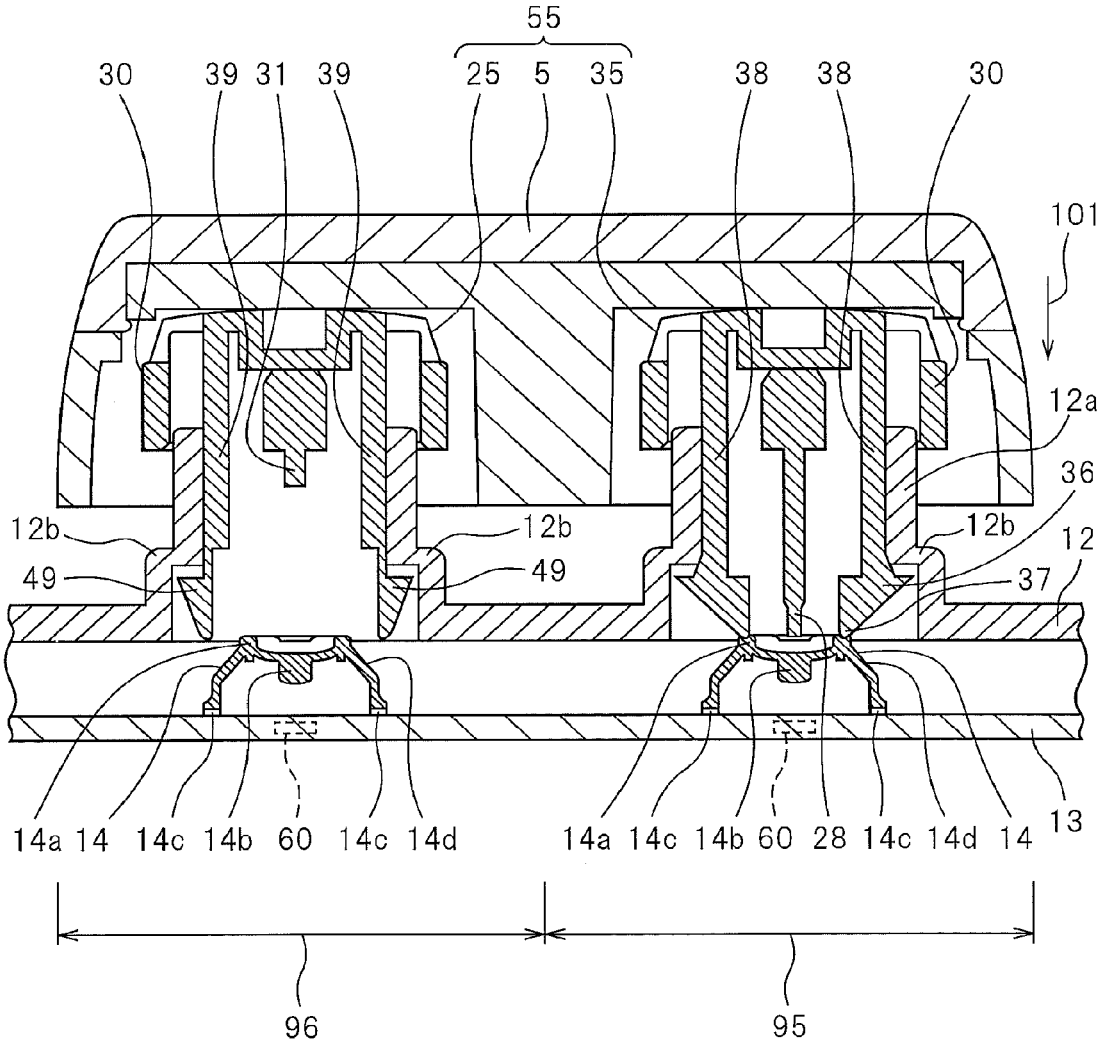
FIG. 10 is a schematic cross-sectional view of a keyswitch device at which a double dimension keytop is arranged in a third keyboard of an embodiment.

FIG. 10 is a schematic cross-sectional view of a keyswitch device at which a second moving member is arranged in a third keyboard of the present embodiment. The third keyboard is formed so as to enable attachment of a second moving member 55 which engages with a plurality of unit parts. The second moving member 55 includes a slider 35 which functions as a first engagement part and a slider 25 which functions as a second engagement part.

The rubber cup 14 in the third keyboard is formed smaller than the rubber cup 14 of the first keyboard. The inside sliding part 38 of the slider 35 includes stopping tabs 36 and a pushing part 37. The stopping tabs 36 are formed to be able to engage with stopping parts 12*b* of the base member 12. The pushing part 37 is formed so as to push the abutting part 14*a* of the rubber cup 14. The structure of the region 95 is similar to the structure of the first keyboard (see FIG. 5), except for the size of the rubber cup 14, the shape of the stopping tabs 36, and the shape of the pushing part 37.

In the third keyboard, the slider 25 of the second moving member 55 includes an inside sliding part 39 which has stopping tabs 49. The stopping tabs 49 are formed to engage with stopping parts 12*b* of the base member 12. The inside sliding part 39 is formed so as to be arranged at the outside of the rubber cup 14 when the keytop 5 is pushed. The interval between the facing stopping tabs 49 is formed to be larger than the outside diameter of the rubber cup 14.

Figure 11:
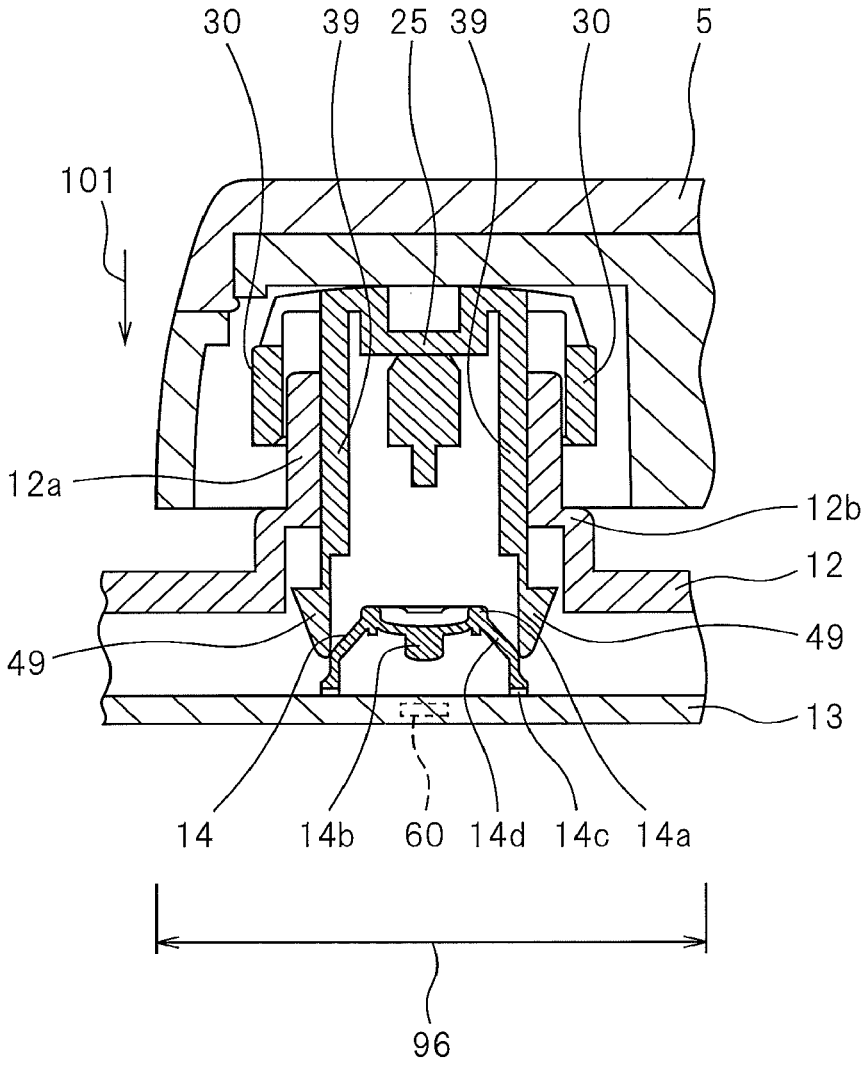
FIG. 11 is a schematic cross-sectional view of a region of a non-connected unit part at which a rubber cup is not pushed in a third keyboard of an embodiment.

FIG. 11 is a schematic cross-sectional view of a part of a non-connected unit part in the third keyboard. FIG. 11 shows the state where the keytop 5 is pushed. In the region of the non-connected unit part 96, stopping tabs 49 which are formed at the ends of the inside sliding part 39 of the slider 25 are arranged at the sides of the rubber cup 14. The inside sliding part 39 of the slider 25 is arranged so as to hold the rubber cup 14 inside it when the keytop 5 is pushed and does not push the rubber cup 14. For this reason, it is possible to avoid the rubber cup 14 being pushed by the slider 25.

In the third keyboard as well, the slider 25 which functions as the second engagement part enables the rubber cup 14 to be kept from being pushed and enables a change in load at the time of change of a keytop to be suppressed. Further, it is possible to obtain electrical connection at the contact 60 of the connected unit part and to avoid electrical connection at a non-connected unit part.

Figure 12:
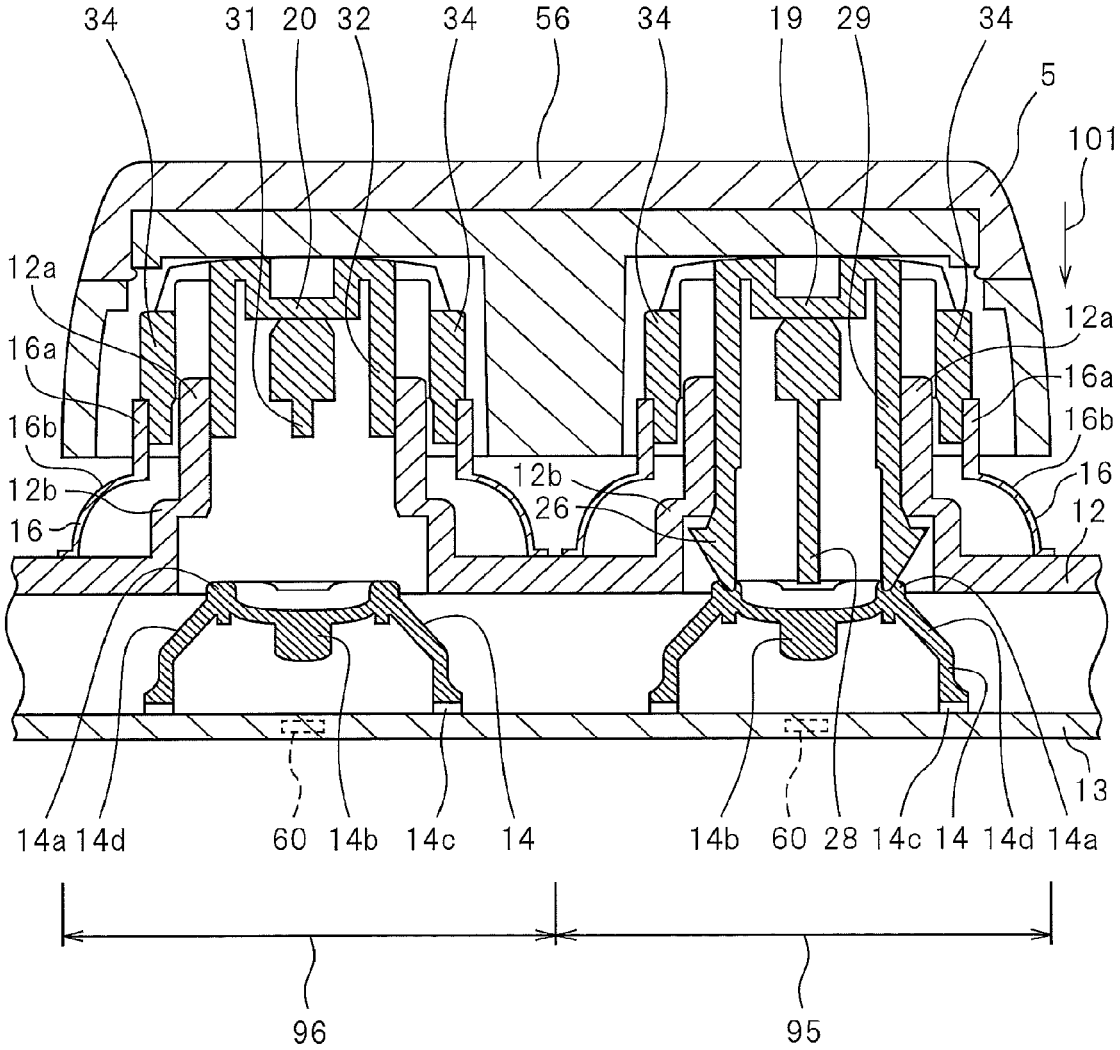
FIG. 12 is a schematic cross-sectional view of a keyswitch device at which a double dimension keytop is arranged in a fourth keyboard of an embodiment.

FIG. 12 is a schematic cross-sectional view of a keyswitch device at which a second moving member is arranged at a fourth keyboard of the present embodiment. The fourth keyboard is formed to be able to attach a second moving member 56. The second moving member 56 includes a slider 19 which functions as a first engagement part and a slider 20 which functions as a second engagement part. The slider 19 has an inside sliding part 29 and an outside sliding part 34. The slider 20 includes an inside sliding part 32 and an outside sliding part 34. The structure where the inside sliding part 29 pushes the rubber cup 14 in the region 95 and where the inside sliding part 32 and rod-shaped part 31 do not reach the rubber cup 14 in the region 96 are similar to the structures of the first keyboard (see FIG. 5).

The fourth keyboard is provided with auxiliary biasing members 16 which are arranged around the outsides of each support part 12*a*. The auxiliary biasing member 16 of the present embodiment 16 is a rubber cup. The auxiliary biasing member 16 includes a tubular part 16*a* which contact the outside sliding part 34 of the slider 19 and 20. The auxiliary biasing member 16 includes an elastically deformable deformation part 16*b* which is connected to the tubular part 16. The deformation part 16*b* is formed so as to cause buckling deformation when the keytop 5 is pushed down. The deformation part 16*b* biases the second moving member 56 in a direction separating from the membrane sheet 13. That is, the auxiliary biasing member 16 provides a reaction force against a pushing operation. The elastic force of the auxiliary biasing member 16 is formed to become smaller than the elastic force of the rubber cup 14.

The auxiliary biasing members 16 are arranged at the surface of the base member 12. The auxiliary biasing member 16 is fastened to the base member 12, but the invention is not limited to this. The auxiliary biasing member may also be fastened to the outside sliding part 34 of the slider 19 and 20. That is, the auxiliary biasing member 16 may be formed so as to detach along with the moving member when replacing the moving member.

The second moving members 52, 54, and 55 of the above-mentioned keyboard are formed so as to push one rubber cup 14 of the connected unit part among the plurality of rubber cups 14. The reaction force from the rubber cup 14 is generated at the region of the connected unit part and is not generated at the region of the non-connected unit part. For this reason, the keytop 5 quickly returns to its original position at the region of the connected unit part, while sometimes becomes slower in returning to its original position at the region of the non-connected unit part.

In the fourth keyboard of the present embodiment, the auxiliary biasing members 16 are arranged corresponding to the respective unit parts. If the user pushes the keytop 5, in the auxiliary biasing members 16, the tubular part 16*a* moves in parallel and pushes down the corresponding deformation part 16*b*. The deformation part 16*b* deforms toward the outside. The auxiliary biasing members 16 provide a reaction force to the sliders 21 and 22. For this reason, when the finger is released from the keytop 5, the keytop 5 can quickly be returned to its original position. In particular, it can quickly return to the original position at the region of the non-connected unit part which is shown by the arrow mark 96.

In this way, the auxiliary biasing member 16 is arranged to return the second moving member 56 to its original position. Therefore, the elastic force of the auxiliary biasing member 16 is preferably sufficiently smaller than the elastic force of the rubber cup 14. The elastic force of the auxiliary biasing member 16 is preferably sufficiently small so as to not have a substantial impact on the load when pushing the keytop 5.

For example, referring to FIG. 6, when the peak load when pushing a keytop 5 (load of local maximum point 81) is 35 grams to 55 grams, the peak load of the auxiliary biasing member 16 is preferably 5 grams or less. For example, the elastic force of the auxiliary biasing member 16 is preferably about one-seventh or less of the elastic force of the rubber cup 14. Furthermore, the elastic force of the auxiliary biasing member 16 is preferably about one-tenth or less of the elastic force of the rubber cup 14.

The auxiliary biasing member of the present embodiment is a rubber cup, but the invention is not limited to this. The auxiliary biasing member can employ any structures which bias the moving member. For example, as the auxiliary biasing member, at least one of a rubber cup, a spring member which is formed by wire in a linear shape, and a coil spring may be included.

Referring to FIG. 1, the explanation was given illustrating a keyswitch device which includes a double dimension keytop 5 which is arranged in the region 91. The size of the keytop of the second moving member is not limited to this. Any size of keytop can be employed. For example, the present invention can also be applied to a second moving member which includes a quadruple dimension keytop which is shown in the region 92 of FIG. 1. In this case, the second moving member includes one first engagement part and three second engagement parts. The four unit parts which engage with the second moving member include one connected unit part 50 and three non-connected unit parts.

Figure 13A:
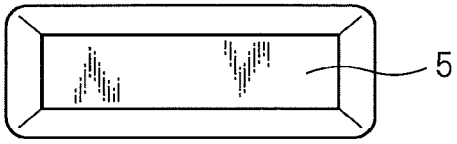
FIG. 13A is a schematic plan view of a keytop of an embodiment.
Figure 13B:
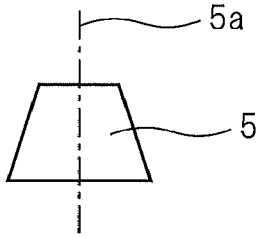
FIG. 13B is a schematic side view of a keytop of an embodiment.

FIG. 13A and FIG. 13B is a view which illustrates a keytop of the present embodiment. FIG. 13A is a schematic plan view of a double dimension keytop 5, while FIG. 13B is a schematic side view of the double dimension keytop 5. The keytop 5 has a pushing surface that is pushed by the user and is formed into a rectangular plan shape. Further, the keytop 5 has a symmetric cross-sectional shape when cut in a direction vertical to the longitudinal direction. That is, as shown in FIG. 13B, it has a symmetric shape about the center axis 5*a* which extends in a direction which is pushed when viewing the side surface.

Figure 14A:
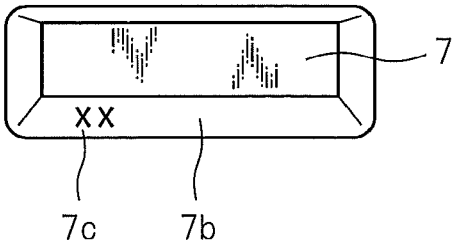
FIG. 14A is a schematic plan view of another keytop of an embodiment.
Figure 14B:
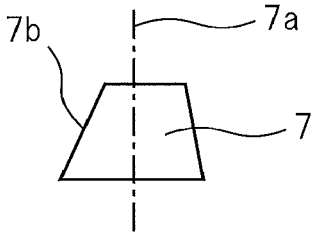
FIG. 14B is a schematic side view of another keytop of an embodiment.

FIG. 14A and FIG. 14B are views which explain another keytop of the present embodiment. FIG. 14A is a schematic plan view of the other keytop 7. FIG. 14B is a schematic side view of the other keytop 7. The other keytop 7 has an asymmetric cross-sectional shape when cut in a direction vertical to the longitudinal direction. As shown in FIG. 14B, when viewing the side surface, it has an asymmetric shape with the center axis 7*a* which extends in the pushing direction. The keytop 7 has a gently slanted side surface 7*b*. The side surface 7*b*, for example, has letters 7*c* engraved on it. To enable the letters 7*c* to be easily viewed when arranging the keytop 7 on the keyboard, the side surface 7*b* is arranged at the side close to the user. In this way, the second moving member which includes the other keytop 7 has directionality when attached to the keyboard. The orientation of the keytop 7 in the longitudinal direction is fixed. In this regard, the user sometimes mistakes the orientation of attachment of the second moving member including the keytop 7. For example, sometimes the side surface 7*b* is arranged at the far side from the user.

As opposed to this, the keytop 5 which is shown in FIG. 13A and FIG. 13B is symmetric in cross-sectional shape about the center axis 5*a*. When attaching the second moving member, it is sufficient to match the longitudinal direction of the keytop 5 with the direction in which the plurality of unit parts are arranged. In this way, it is possible to avoid the direction of attachment of the second moving member from ending up being mistaken. The second moving member which includes the keytop 5 can be attached by the work of matching the longitudinal direction, so replacement is easier than the asymmetric keytop 7 which is shown in FIG. 14A and FIG. 14B.

In the present embodiment, a keytop and a slider are formed as separate parts, but the invention is not limited to this. The keytop and the slider may also be formed integrally from a single material.

The keyboard of the present embodiment includes a single membrane sheet in which contacts are formed, but the invention is not limited to this. A plural membrane sheet can be used.

The above embodiments may be suitably combined. In the above figures, the same or corresponding parts are assigned the same reference numerals. Note that the above embodiments are illustrations and do not limit the invention. Further, in the embodiments, the changes in the embodiments which are shown in the claims are included.

The invention claimed is:

1. A keyboard comprising:

a base member;

elastic members;

support parts connected to said base member;

sliders, respectively supported by said support parts, including first sliders configured to push said elastic members, respectively, and second sliders configured to not push said elastic members;

keytops, each connected to at least one slider moving with the at least one slider connected thereto when pushed; and an electrical connecting member, wherein when one of the keytops is depressed, one of the sliders connected to the depressed keytop deforms one of the elastic members and the deformed elastic member pushes the electrical connecting member to make an electrical connection, said keytops including a first keytop attached to one of said first sliders and none of said second sliders, and a second keytop attached to at least one of said first sliders and at least one of said second sliders, said first keytop with the respectively connected sliders and said second keytop with the respectively connected sliders are exchangeably attached to and detached from said base member.

2. The keyboard as set forth in claim 1, wherein said first sliders and said second sliders are formed so as to face said support parts and slides against the respectively supporting support parts, and said second sliders are formed shorter than said first sliders so that a clearance is formed between said second sliders, connected to said second keytop, and said elastic member when said second keytop is pushed.

3. The keyboard as set forth in claim 1, wherein said first sliders and said second sliders are formed so as to face the respectively supporting support parts and slide against the respectively supporting support parts, and and said second sliders slide against the outside of the respectively supporting support parts and form an empty space inside the respectively supporting support parts.

4. The keyboard as set forth in claim 1, wherein said first sliders and said second sliders are formed so as to face the respectively supporting support parts and slide against the respectively supporting support parts, and said second sliders, connected to said second keytop, being arranged at a side of said elastic member when said second keytop is pushed.

5. The keyboard as set forth in claim 1, wherein said second keytop includes a pushing surface which is pushed by a user, wherein said second keytop has a cross-sectional shape which is symmetric about a center axis which extends in the pushing direction when cutting in a direction vertical to the longitudinal direction.

6. The keyboard as set forth in claim 1, further comprising a biasing member which is arranged around said support parts and which biases said keytops and the respectively connected sliders in a direction away from said electrical connecting member, wherein an elastic force of said biasing member is smaller than an elastic force of said elastic member.

7. A keyboard comprising:

a base member;

moving members provided on said base member, each of which moves when being pushed;

unit parts, each including a contact which is formed in an electrical connecting member and electrically connected when depressed, an elastic member which is arranged between said moving member and said electrical connecting member, which deforms upon being pushed by said moving member and which pushes said electrical connecting member, and a support part provided on said base member that supports said moving member; and a biasing member which is arranged around said support part and which biases said moving member in a direction away from said electrical connecting member, wherein an elastic force of said biasing member is smaller than an elastic force of said elastic member; wherein said moving members include a first moving member which engages with one unit part, and a second moving member which engages with plural unit parts, said first moving member and said second moving member are exchangeably attached to and detached from said base member, and said second moving member has a structure where said second moving member pushes said elastic member of one unit part among said unit parts which are engaged with and avoids pushing said elastic member of the other unit part.

* * * * *

UNITED STATES PATENT AND TRADEMARK OFFICE

CERTIFICATE OF CORRECTION

PATENT NO. : 9,318,282 B2
APPLICATION NO. : 14/047493
DATED : April 19, 2016
INVENTOR(S) : Takashi Nakajima et al.

It is certified that error appears in the above-identified patent and that said Letters Patent is hereby corrected as shown below:

In the claims,
Claim 3, Column 12, Line 45:
Delete "and said" and insert -- said --, therefor.

Signed and Sealed this
Twenty-sixth Day of July, 2016

Michelle K. Lee

Michelle K. Lee
*Director of the United States Patent and Trademark Office*